US008747144B2

(12) United States Patent
Zhang

(10) Patent No.: US 8,747,144 B2
(45) Date of Patent: Jun. 10, 2014

(54) LATCHING MECHANISM AND CONNECTOR ASSEMBLY USING THE SAME

(75) Inventor: Jun-Liang Zhang, Shenzhen (CN)

(73) Assignees: Fu Tai Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 44 days.

(21) Appl. No.: 13/570,231

(22) Filed: Aug. 8, 2012

(65) Prior Publication Data

US 2013/0183847 A1 Jul. 18, 2013

(30) Foreign Application Priority Data

Jan. 13, 2012 (CN) ..... 2012 1 0009543

(51) Int. Cl.
*H01R 13/62* (2006.01)

(52) U.S. Cl.
USPC ..... 439/369

(58) Field of Classification Search
USPC ..... 439/369, 370, 346, 263; 307/119
See application file for complete search history.

(56) References Cited

U.S. PATENT DOCUMENTS 4,627,681 A * 12/1986 Hong ..... 439/370
4,875,874 A * 10/1989 Windsor, Jr. ..... 439/369
5,197,897 A * 3/1993 Torok ..... 439/263
5,393,243 A * 2/1995 Carmo ..... 439/369
5,785,547 A * 7/1998 Cross et al. ..... 439/369
5,893,772 A * 4/1999 Carmo et al. ..... 439/346
5,941,724 A * 8/1999 Reed ..... 439/346
6,428,339 B1 * 8/2002 Davidson et al. ..... 439/346
6,619,975 B2 * 9/2003 Bentley et al. ..... 439/346
6,676,428 B2 * 1/2004 Burton ..... 439/270
6,875,040 B1 * 4/2005 O'Keefe et al. ..... 439/346
7,052,303 B2 * 5/2006 Burton ..... 439/346
7,182,615 B1 * 2/2007 Liu ..... 439/263
7,186,130 B1 * 3/2007 Miller ..... 439/369
7,582,990 B2 * 9/2009 Haas ..... 307/119
8,083,539 B2 * 12/2011 Suzuki et al. ..... 439/427

* cited by examiner

*Primary Examiner* — Alexander Gilman

(74) *Attorney, Agent, or Firm* — Novak Druce Connolly Bove + Quigg LLP

(57) ABSTRACT

A latching mechanism for latching a plug to a socket is provided. The socket has a housing for receiving the latching mechanism. The latching mechanism includes a latching member slidably received in the housing and a rotating member rotatably received in the housing. The latching member is capable of sliding between a latching position for latching the plug to the socket and an unlatching position for allowing the plug to be disengaged from the socket. The rotating member drives the latching member to slide between the latching position and the unlatching position when rotated. A connector assembly using the latching mechanism is also provided.

17 Claims, 4 Drawing Sheets

LATCHING MECHANISM AND CONNECTOR ASSEMBLY USING THE SAME

BACKGROUND

1. Technical Field

The present disclosure relates to connector assemblies, and particularly to a connector assembly having a plug, a socket, and a latching mechanism for latching the plug to the socket when the plug is inserted into the socket.

2. Description of Related Art

Electronic devices are electronically connected to an external power supply by a plug of a power cable being inserted into a socket, and the plug must be engaged with the socket during the operation of the electronic devices. However, the plug may be disengaged inadvertently which will result in the electronic device losing power.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the four views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one".

Figure 1:
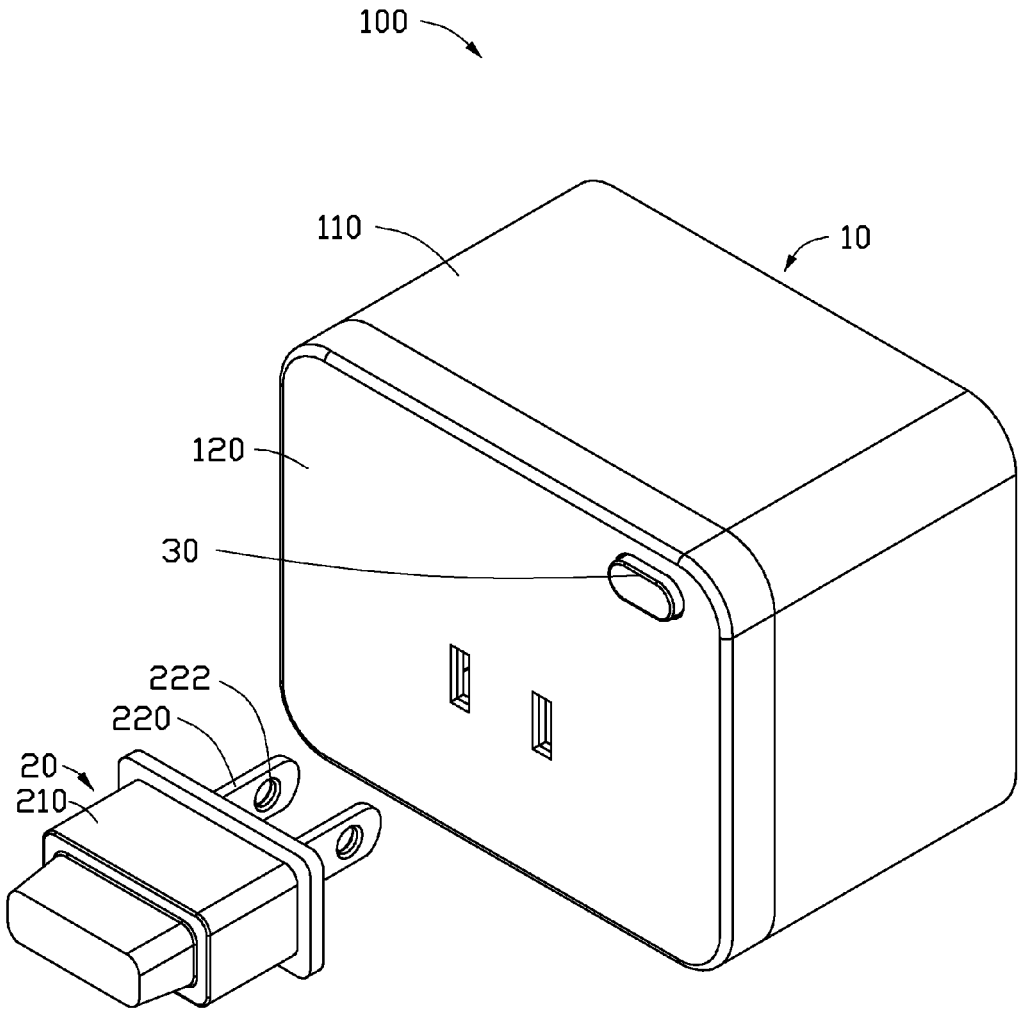
FIG. 1 is a perspective view of a connector assembly having a socket and a plug in accordance with an embodiment.

Referring to FIG. 1, a connector assembly 100 includes a socket 10, a plug 20, and a latching mechanism 30 housed in the socket 10. The plug 20 is detachably inserted into the socket 10. The latching mechanism 30 is used to latch the plug 20 to the socket 10 when the plug 20 has been inserted into the socket 10. In the embodiment, the plug 20 is a two-pin plug, and the socket 10 is a two-core socket matching the two-pin plug.

The plug 20 includes a base 210 and two contacts 220 secured to the base 210. The contacts 220 are parallel to each other, and are electrically connected to a cable (such as a power cable, not shown). Each contact 220 defines a circular latching hole 222. The latching holes 222 are coaxial and are arranged at the ends of each contact 220 away from the base 210.

Figure 2:
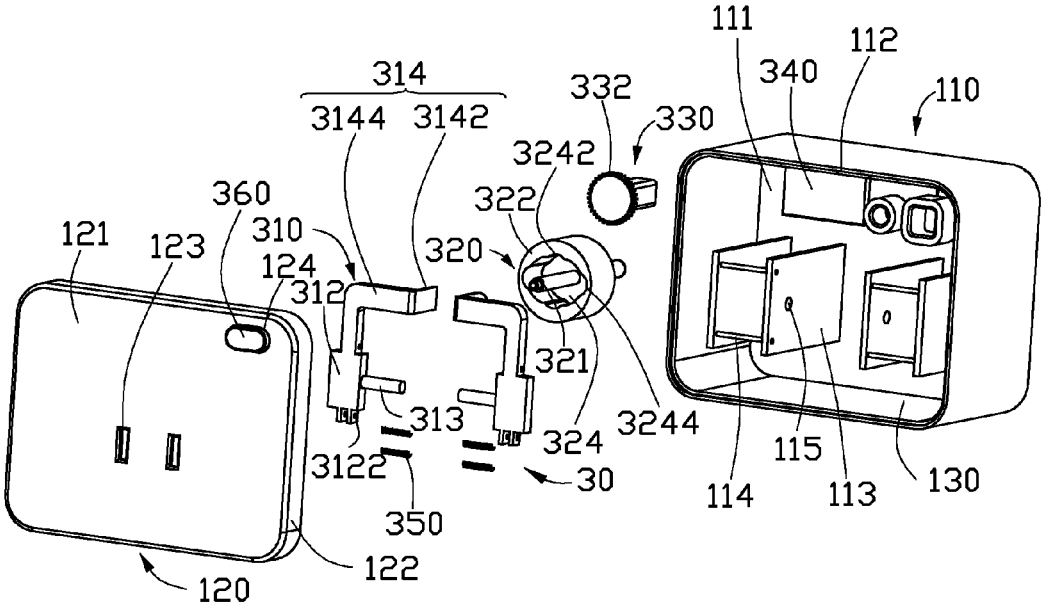
FIG. 2 is a disassembled view of the socket of the connector assembly of FIG. 1.

Referring to FIG. 2, the socket 10 is substantially a rectangular hollow. The socket 10 includes a bottom case 110 and a top case 120. The bottom case 110 engages with the top case 120 to form a receiving space 130 for receiving the latching mechanism 30. The top case 120 includes a substantially rectangular top wall 121 and four flanges 122 extending from rims of the top wall 121. The top wall 121 defines two engaging holes 123 corresponding to the contacts 220. The engaging holes 123 allow the contacts 220 to be inserted into the socket 10. The top wall 121 further defines a through hole 124. The through hole 124 is arranged adjacent to a corner of the top wall 121.

The bottom case 110 includes a bottom wall 111 and four sidewalls 112. The bottom wall 111 is substantially rectangular and corresponds to the top wall 121. The sidewalls 112 perpendicularly extend from rims of the bottom wall 111 and correspond to the flanges 122. Two pairs of supporting plates 113 are perpendicularly secured on an inner surface of the bottom wall 111. Each pair of supporting plates 113 is spaced from the other. Two sliding posts 114 are perpendicularly secured to each pair of the supporting plates 113 and are spaced from each other. The two inner supporting plates 113 arranged between the other two supporting plate 113 define two round holes 115. Each round hole 115 is equidistant from the two sliding posts 114.

The latching mechanism 30 includes two latching members 310, a rotating member 320, a driving member 330, a driving circuit 340 and a plurality of elastic members 350. Each latching member 310 is slidably secured to the sliding posts 114, and is capable of sliding between a latching position for latching the plug 20 to the socket 10 and an unlatching position for allowing the plug 20 to disengage from the socket 10. Each latching member 310 includes a main body 312 slidably secured to the sliding posts 114, a latching post 313 secured to the main body 312, and a driving arm 314. Opposite ends of the main body 312 define sliding holes 3122 for slidably receiving the sliding posts 114. The latching post 313 is arranged at a side of the main body 312 facing the other latching member 310 and corresponds to the round hole 115. The latching post 313 is parallel to the sliding posts 114. The driving arm 314 is secured to an end of the main body 312. The driving arm 314 and the latching post 313 are arranged at the same side of the main body 312. The driving arm 314 includes an abutting portion 3142 abutting the rotating member 320 and a connecting portion 3144 connecting the abutting portion 3142 to the main body 312. The abutting portion 3142 is secured to an end of the connecting portion 3144 away from the main body 312 and extends toward the bottom wall 111.

The rotating member 320 is rotatably secured to the bottom wall 111, and drives the latching member 310 to slide from the latching position to the unlatching position or vice versa when it is rotated. The rotating member 320 includes a shaft 321 rotatably secured to the bottom wall 111, a cylinder 322 fixed to the shaft 321, and a slave gear 323 (see FIG. 3) fixed to the shaft 321 and connecting with the cylinder 322. The cylinder 322 and the slave gear 323 are coaxial with the shaft 321. An end of the cylinder 322 away from the slave gear 323 is recessed to define a receiving portion 324 for receiving the abutting portions 3142. The receiving portion 324 extends in a direction parallel to the shaft 321. The sidewall of the receiving portion 324 is recessed in a direction away from the shaft 321 to define opposite first recesses 3242 and opposite second recesses 3244. The first recesses 3242 and the second recesses 3244 are arranged orthogonally, that is to say, substantially an oval shape is marked out by the receiving portion 324. The distance between the first recesses 3242 is different from the distance between the second recesses 3244. In the embodiment, the distance between the first recesses 3242 is less than the distance between the second recesses 3244. The first and second recesses 3242, 3244 are smoothly joined to the sidewall of the receiving portion 324.

The driving member 330 is secured to the inner surface of the bottom wall 111, and is used to rotate the rotating member 320. The driving member 330 has a drive gear 332. The drive gear 332 engages with the slave gear 323. In the embodiment, the driving member 330 may be a step motor, or a servomotor.

The driving circuit 340 is secured to the bottom wall 111. The driving circuit 340 is electrically connected to the driving member 330 and controls the driving member 330 when powered on.

The latching mechanism 30 further includes a button 360. The button 360 is mounted in the through hole 124. The button 360 is electrically connected to the driving circuit 340 and is used to power on and/or power off the driving circuit 340 when pressed.

An elastic member 350 sleeves on each of the four sliding posts 114. The elastic members 350 provide an elastic force for driving the abutting portions 3142 of the latching members 410 to continuously abut the sidewall of the receiving portion 324.

Figure 3:
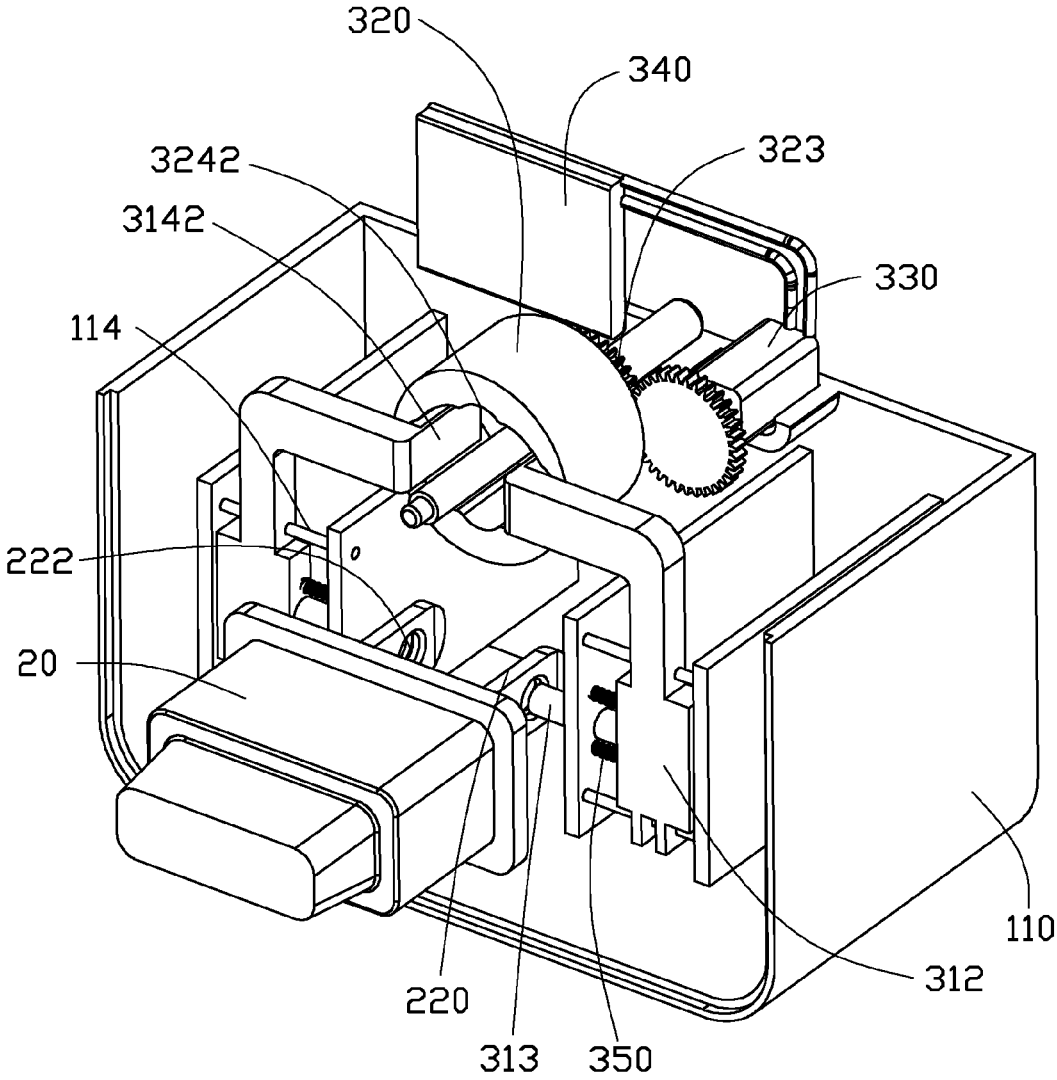
FIG. 3 is a partial perspective view showing the plug being inserted into the socket of FIG. 1.

Referring to FIG. 3, in assembly, the driving member 330 is secured to the bottom wall 111. The rotating member 320 is rotatably secured to the bottom wall 111 with the slave gear 323 engaging with the drive gear 332. The abutting portions 3142 are received in the receiving portion 324, and the sliding posts 114 extend through the sliding holes 3122 to slidably secure the latching members 310 to the supporting plates 113. Each elastic member 350 sleeves on the sliding posts 114 and is arranged between the main body 312 and the supporting plate 113 adjacent to the other latching member 310, to provide an elastic force for driving the abutting portions 3142 of the latching member 310 to continuously abut the sidewall of the receiving portion 324. Finally, the button 360 is mounted in the through hole 124, and the top case 120 covers on the bottom case 110.

After assembly, because of the elastic force provided by the elastic members 350, the abutting portions 3142 of the latching member 310 continuously abut the sidewalls of the receiving portion 324, and the abutting portions 3142 slide along the sidewalls of the receiving portion when the rotating member 320 is rotated. Because the distance between the first recesses 3242 is less than the distance between the second recesses 3244, the distance between the latching posts 313 (which are always symmetrical about the center of the receiving portion 324) is changeable. In detail, when the abutting portions 3142 slide into and are received in the first recesses 3242, the distance between the latching posts 313 is at the minimum and is less than the distance between the contacts 220; at this time, the latching members 310 are in the latching position. When the abutting portions 3142 slide into and are received in the second recesses 3244, the distance between the latching posts 313 is at the maximum and is greater than the distance between the contacts 220; at this time, the latching members 310 are in the unlatching position.

Figure 4:
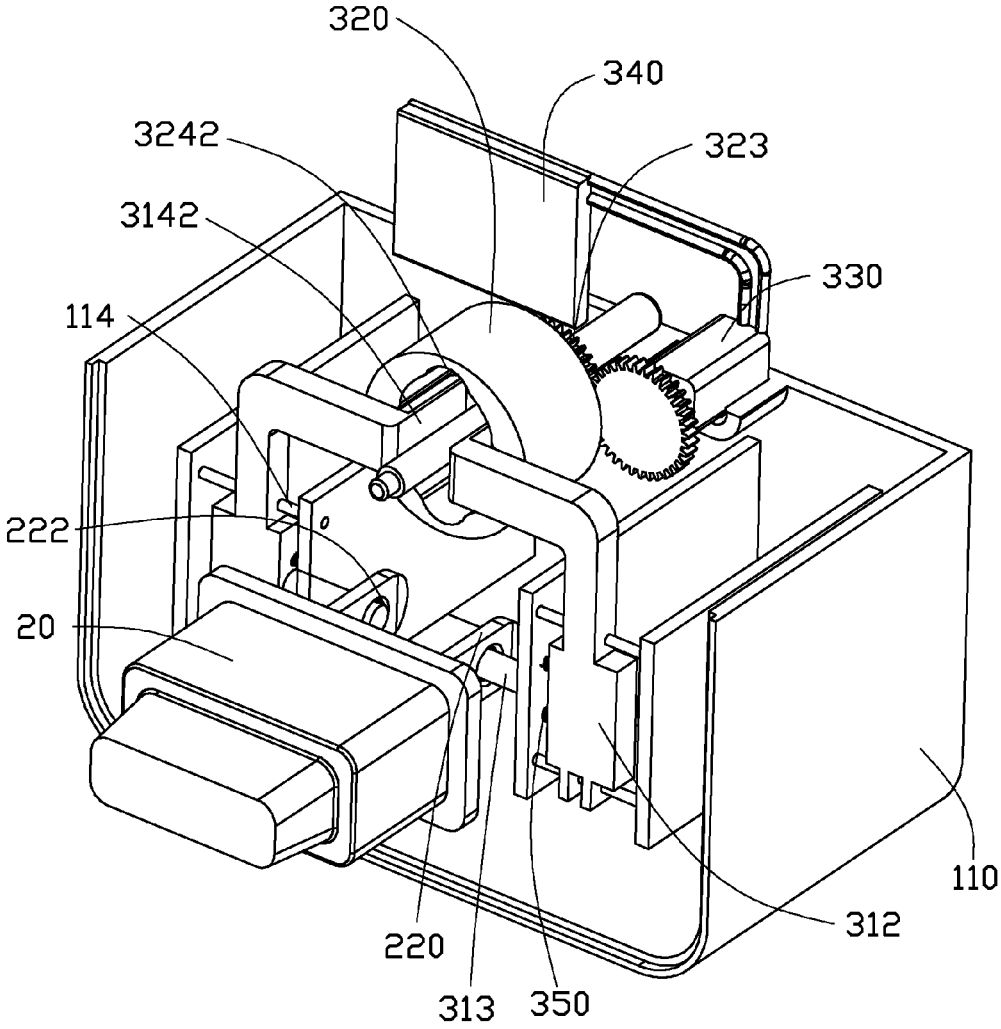
FIG. 4 is a partial perspective view showing the plug as latched to the socket of FIG. 1.

Referring to FIG. 4, to latch the plug 20 to the socket 10: first, press the button 360 to drive the latching members 310 to the unlatching position, and the abutting portions 3142 are received in the second recesses 3244; second, the contacts 220 of the plug 20 are inserted into the engaging holes of the socket 10; press the button 360 again to drive the rotating member 320 to rotate either clockwise or anticlockwise 90 degrees, and the abutting portions 3142 slide to the first recesses 3242, to drive the latching posts 313 towards each other to be received in the latching holes 222. As a result, the plug 20 is latched by the latching posts 313 and is prevented from disengaging with the socket 10.

Referring again to FIG. 3, to unlatch the plug 20 from the socket 10: press the button 360 again to turn the rotating member 320 another 90 degrees, and the abutting portions 3142 slide back to the second recesses 3244, allowing the latching posts 313 to move away from each other, to be disengaged from the latching holes 222. As a result, the plug 20 can then be pulled out of the socket 10.

Although certain embodiments have been set forth in the foregoing description, together with details of the structures and functions of the present embodiments, the disclosure is illustrative only; and that changes may be made in detail, especially in the matters of shape, size, and arrangement of parts within the principles of the present embodiments to the full extent indicated by the broad general meaning of the terms in which the appended claims are expressed.

What is claimed is:

1. A latching mechanism for latching a plug to a socket, the socket having a housing for receiving the latching mechanism, the plug comprises at least one contact capable of being inserted into the socket and defining a latching hole, comprising:

a latching member slidably received in the housing and capable of sliding between a latching position for latching the plug to the socket and an unlatching position for allowing the plug to be disengaged from the socket; and a rotating member rotatably received in the housing;

wherein when the rotating member rotates, the rotating member drives the latching member to slide between the latching position and the unlatching position; wherein a latching post is secured to the latching member, and the latching post is inserted into the latching hole of the plug to latch the plug to the socket when the latching member slides to the latching position.

2. The latching mechanism of claim 1, further comprising a driving member engaging with the rotating member, wherein the driving member is used to drive the rotating member to rotate.

3. The latching mechanism of claim 2, further comprising a driving circuit electrically connected to the driving member, wherein the driving circuit controls the driving member when powered on.

4. The latching mechanism of claim 2, wherein the driving member is one selected from a group of a step motor and a servomotor.

5. The latching mechanism of claim 3, further comprising a button mounted on the housing and electrically connected to the driving circuit, wherein the button powers on and/or powers off the driving circuit when being pressed.

6. The latching mechanism of claim 1, wherein the rotating member comprises a shaft rotatably secured to the housing and a cylinder fixed to the shaft, the cylinder recesses to form a receiving portion extending in a direction parallel to the shaft.

7. The latching mechanism of claim 6, wherein the sidewall of the receiving portion recesses in a direction away from the shaft to define opposite first recesses and opposite second recesses, the first recesses and the second recesses are arranged orthogonally, and the distance between the first recesses is different from the distance between the second recesses.

8. The latching mechanism of claim 7, wherein the latching member comprises a main body slidably secured to the housing, and a driving arm secured to the main body and received in the receiving portion; the latching post is secured to the main body.

9. The latching mechanism of claim 8, further comprising at least one elastic member, wherein the at least one elastic member abuts the main body for providing an elastic force to drive the driving arm continuously abutting the sidewall of the receiving portion.

10. The latching mechanism of claim 9, wherein the plug comprises at least one contact capable of being inserted into the socket, the at least one contact defines the latching hole for receiving the latching post.

11. A connector assembly, comprising:

a socket having a housing;

a plug capable of being detachably inserted into the socket; and a latching mechanism received in the housing and for latching the plug to the socket when the plug is inserted into the socket, the latching mechanism comprising:

a latching member slidably received in the housing and capable of sliding between a latching position for latching the plug to the socket and an unlatching position for allowing the plug to be disengaged from the socket; and a rotating member rotatably received in the housing, the rotating member driving the latching member to slide between the latching position and the unlatching position when rotates;

wherein the rotating member comprises a shaft rotatably secured to the housing and a cylinder fixed to the shaft, the cylinder recesses to form a receiving portion extending in a direction parallel to the shaft.

12. The connector assembly of claim 11, wherein the sidewall of the receiving portion recesses in a direction away from the shaft to define opposite first recesses and opposite second recesses, the first recesses and the second recesses are arranged orthogonally, and the distance between the first recesses is different from the distance between the second recesses.

13. The connector assembly of claim 12, wherein the latching member comprises a main body slidably secured to the housing, a latching post secured to the main body, and a driving arm secured to the main body and received in the receiving portion.

14. The connector assembly of claim 13, wherein the latching mechanism further comprises at least one elastic member, the at least one elastic member abuts the main body for providing an elastic force to drive the driving arm continuously abutting the sidewall of the receiving portion.

15. The connector assembly of claim 14, wherein the plug comprises at least one contact capable of being inserted into the socket, the at least one contact defines a latching hole for receiving the latching post.

16. A latching mechanism for latching a plug to a socket, the socket having a housing for receiving the latching mechanism, comprising:

a latching member slidably received in the housing and capable of sliding between a latching position for latching the plug to the socket and an unlatching position for allowing the plug to be disengaged from the socket; and a rotating member rotatably received in the housing;

wherein when the rotating member rotates, the rotating member drives the latching member to slide between the latching position and the unlatching position; wherein the latching mechanism further comprises a driving member engaging with the rotating member and a driving circuit electrically connected to the driving member, wherein the driving member is used to drive the rotating member to rotate; the driving circuit controls the driving member when powered on.

17. The latching mechanism of claim 16, further comprising a button mounted on the housing and electrically connected to the driving circuit, wherein the button powers on and/or powers off the driving circuit when being pressed.

* * * * *